US010130535B2

(12) United States Patent
Purwar et al.

(10) Patent No.: US 10,130,535 B2
(45) Date of Patent: Nov. 20, 2018

(54) FOUR BAR APPARATUS AND METHOD FOR LIFTING, LOWERING, EXERCISE AND SELF-PROPELLED TRANSIT

(71) Applicant: The Research Foundation for The State University of New York, Albany, NY (US)

(72) Inventors: Anurag Purwar, Albany, NY (US); Bipin Birari, Stony Brook, NY (US)

(73) Assignee: The Research Foundation for The State University of New York, Albany, NY (US)

( * ) Notice: Subject to any disclaimer, the term of this patent is extended or adjusted under 35 U.S.C. 154(b) by 273 days.

(21) Appl. No.: 14/783,289

(22) PCT Filed: Apr. 21, 2014

(86) PCT No.: PCT/US2014/034781

§ 371 (c)(1),
(2) Date: Oct. 8, 2015

(87) PCT Pub. No.: WO2014/172700

PCT Pub. Date: Oct. 23, 2014

(65) Prior Publication Data

US 2016/0051427 A1 Feb. 25, 2016

Related U.S. Application Data

(60) Provisional application No. 61/813,873, filed on Apr. 19, 2013.

(51) Int. Cl.
*A63B 21/005* (2006.01)
*A61H 1/00* (2006.01)
(Continued)

(52) U.S. Cl.
CPC ..... *A61G 5/14* (2013.01); *A61G 7/10* (2013.01); *A61G 7/1013* (2013.01);
(Continued)

(58) Field of Classification Search
CPC ..... A61G 5/14; A61G 7/10; A61G 7/1001; A61G 7/1013–7/1017; A61G 7/1019;
(Continued)

(56) References Cited

U.S. PATENT DOCUMENTS 3,640,566 A * 2/1972 Hodge ..... A61G 5/006 297/68
4,569,556 A * 2/1986 Pillot ..... A61G 5/14 297/316

(Continued)

FOREIGN PATENT DOCUMENTS

EP 1852099 11/2007
JP H0871114 3/1996

OTHER PUBLICATIONS

PCT/ISA/210 Search Report issued on PCT/US2014/034781 (pp. 3).
PCT/ISA/237 Written Opinion issued on PCT/US2014/034781 (pp. 5).

*Primary Examiner* — Nyca T Nguyen
(74) *Attorney, Agent, or Firm* — The Farrell Law Firm, P.C.; John F. Gallagher, III

(57) ABSTRACT

A four bar apparatus and method are provided for lifting, lowering, providing exercise and facilitating self-propelled transit. The apparatus includes an actuator and interconnected four-bar lifting mechanism, which includes a crank, a coupler, a rocker, and a frame. Each of the crank, coupler, rocker and frame are rotatably interconnected, and operation of the actuator moves a lift point of the coupler, with the lift point connectable to a vest-type garment or belt worn by a
(Continued)

user of the apparatus, with the lift point following a J shape path or an S shape path to lift the user from a shoulder or hip area, respectively.

14 Claims, 13 Drawing Sheets

(51) Int. Cl.

| | |
|---|---|
| ***A63H 1/02*** | (2006.01) |
| ***A63H 5/00*** | (2006.01) |
| ***A61G 5/14*** | (2006.01) |
| ***A61G 7/10*** | (2006.01) |
| ***A61H 3/04*** | (2006.01) |
| ***A63B 21/00*** | (2006.01) |
| ***A63B 21/068*** | (2006.01) |

(52) U.S. Cl.
CPC ..... *A61G 7/1046* (2013.01); *A61H 3/04* (2013.01); *A63B 21/00069* (2013.01); *A63B 21/00181* (2013.01); *A63B 21/068* (2013.01); *A61G 7/1051* (2013.01)

(58) Field of Classification Search
CPC .. A61G 7/1023; A61G 7/1038; A61G 7/1046; A61G 7/1049; A61G 7/1051; A63B 21/068; A63B 21/00181; A63B 21/00069; A63B 22/0048; A63B 2022/0051; A63B 2022/0053; A63B 21/005; A63B 21/008; A63B 21/0083; A63B 21/0085; A63B 21/0087; A61H 3/04
See application file for complete search history.

(56) References Cited

U.S. PATENT DOCUMENTS

| | | | | |
|---|---|---|---|---|
| 5,137,102 | A | 8/1992 | Houston, Sr. et al. | |
| 5,630,236 | A | 5/1997 | Messin | |
| 5,785,070 | A | 7/1998 | Block et al. | |
| 6,503,176 | B2 | 1/2003 | Kuntz | |
| 6,733,018 | B2 | 5/2004 | Razon | |
| 2007/0232965 | A1* | 10/2007 | Talish | A61H 1/005 601/5 |
| 2012/0047648 | A1* | 3/2012 | Purwar | A61G 7/1017 5/86.1 |
| 2012/0255118 | A1 | 10/2012 | Hammond et al. | |
| 2013/0219615 | A1* | 8/2013 | Eklof | A61G 7/1017 5/83.1 |
| 2013/0221716 | A1* | 8/2013 | Purwar | A61G 7/1017 297/311 |
| 2017/0128293 | A1* | 5/2017 | Tsusaka | A61G 5/14 |

* cited by examiner

FOUR BAR APPARATUS AND METHOD FOR LIFTING, LOWERING, EXERCISE AND SELF-PROPELLED TRANSIT

PRIORITY

This application claims priority to Provisional Patent Application No. 61/813,873 filed Apr. 19, 2013, the content of which is incorporated herein by reference.

BACKGROUND OF THE INVENTION

Field of the Invention

This invention relates generally to an apparatus for lifting, lowering, and self-propelled transit of a person having limited use of their legs or limited leg strength.

Description of Related Art

Many people require assistance moving between standing and seated positions. To reduce dependence on others, numerous devices have been developed, particularly in regard to performing everyday activities.

A conventional device for the transit of partially incapacitated persons includes U.S. Pat. No. 5,785,070 to Block et al., which provides an apparatus having a first set of handles used to assist the person when in a standing position and a second set of handles provided in a position beneath the first set of handles. The second set of handles provides resistance for use when rising to a standing position. However, the apparatus of Block et al. requires use of a person's own strength to achieve the standing position, and creates an awkward sitting scenario wherein the user has to lean backward, shift weight onto the second set of handles, which may be behind and beneath the user, and then bend their knees to complete the sitting motion.

Another conventional device is described in U.S. Pat. No. 6,503,176 to Kuntz, which provides a device having a compressed air assembly and a support sling to lift the user from a seated position. The device of Kuntz does not require use of upper body strength to achieve a standing position. However, the device requires use of a compressed air cylinder for power, which is inconvenient to a user due to the weight, cost and impracticality of having to transport and refill compressed air tanks. An additional limitation of Kuntz and other conventional devices is that a user is lifted along a path that differs from a natural standing motion. The unnatural lift motion makes conventional device uncomfortable to use and reduces stability.

Yet another conventional device is described in U.S. Pat. No. 6,733,018 to Razon, which provides a stand up walker for supporting the body weight in a standing position. In Razon, a pair of upper lift arms is mounted on a walker frame with a lift spring, which lifts a user. However, the lifting motion provided by the device of Razon is unnatural, inefficient, and generally painful when the point of application of lifting force is provided at the armpits. While being lifted from the hips using a sling, ensuring the stability of the device is a major challenge since the center of gravity of the person being lifted is usually outside the footprint of the device. Also, for gas springs to effectively operate, exertion of a user's own strength is required during the lifting phase, to ensure that the gas springs compress during the sitting phase. In addition, gas springs generally do not provide a smooth lifting motion.

Conventional devices fail to provide a user with a stable lifting apparatus that can be repeatedly used without fatigue. Conventional devices also fail to lift a user along a natural path of the lifting motion.

To overcome shortcomings of conventional devices, the present invention provides an apparatus and method for lifting a person along a natural path of motion, from either a hip or shoulder lifting point, both of which provides a natural lifting operation. The apparatus can support the user's weight at the buttocks or alternatively at the armpit/shoulder region while maintaining stability throughout the entire range of motion. The user of the apparatus of the present invention can also utilize a sling thereof as a seat when not in use as a walker. The present invention also provides lifting/lowering assistance between seated/standing positions, functions as a standard walker and/or gait trainer, and also provides a method for lifting assistance to provide exercise during patient rehabilitation.

SUMMARY OF THE INVENTION

To overcome the deficiencies of conventional devices, the present invention provides a four bar apparatus and method for lifting, lowering, providing exercise and facilitating self-propelled transit. The apparatus includes an actuator and interconnected four-bar lifting mechanism, which includes a crank, a coupler, a rocker, and a frame. Each of the crank, coupler, rocker and frame are rotatably interconnected, and operation of the actuator moves a lift point for connection to a garment worn by a user, with the lift point positioned on a distal end of the coupler following a J-shape path when the lift point is connected to a user's shoulder area and following an S-shape path when connected to the user's hip area.

An aspect of the invention provides a patient lifting apparatus that includes a crank, a rocker, a frame, and a coupler having a lift point on an end thereof, with a first end of the coupler opposite the lift point rotatably connected to a second end of the rocker at a first axis, a first end of the rocker rotatably connected to the frame at a second axis, a first end of the crank rotatably connected to the frame at a third axis, a second end of the crank rotatably connected to the coupler at a fourth axis, and one of raising and lowering of the lift point is performed by rotation of one of the coupler relative to the rocker, the rocker relative to the frame, the crank relative to the frame, and the crank relative to the coupler.

In a further embodiment, a method of lifting a user of a portable lifting apparatus is provided that includes sitting a user on a chair, positioning the chair in a partial free space of the apparatus, operating an actuator that equally assists the user between seated and standing positions, and providing a harness or sling as a seat for use in the event that the user grows weary and/or to arrest an accidental fall of the user.

BRIEF DESCRIPTION OF THE DRAWINGS

For a better understanding of the invention, as well as other objects and further features thereof, reference is made to the following detailed description to be read in conjunction with the accompanying drawings, wherein.

DESCRIPTION OF THE PREFERRED EMBODIMENTS

The following detailed description of preferred embodiments is made with reference to the accompanying drawings. In describing the invention, explanation of related functions or constructions known in the art is omitted for the sake of clarity in understanding the concept of the invention and to avoid obscuring the description of the invention with unnecessary details.

Figure 1:
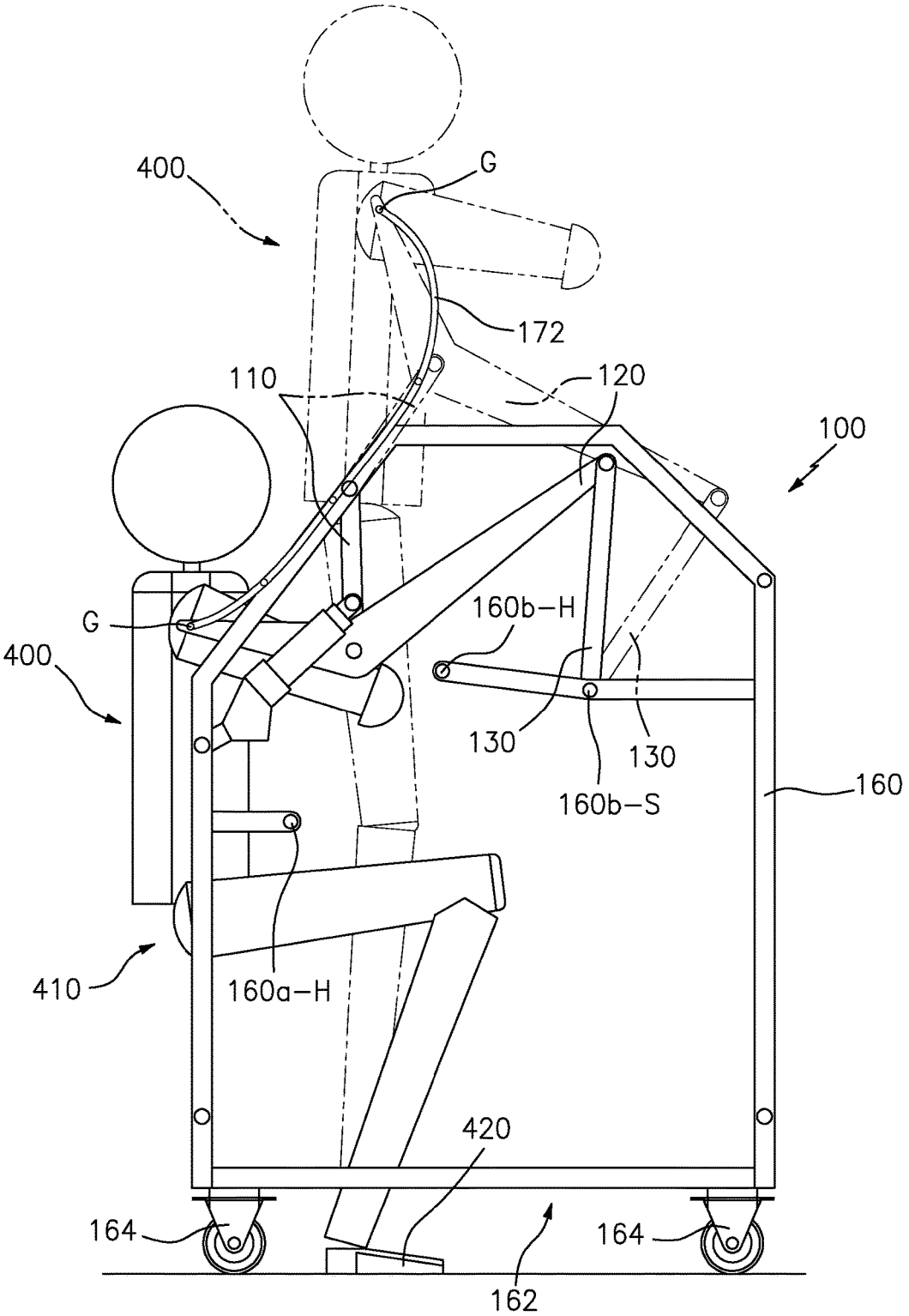
FIG. 1 is a side view showing progression of user during lift from a shoulder point from between seated and standing positions utilizing a four bar lifting mechanism of a first embodiment of the present invention.
Figure 2:
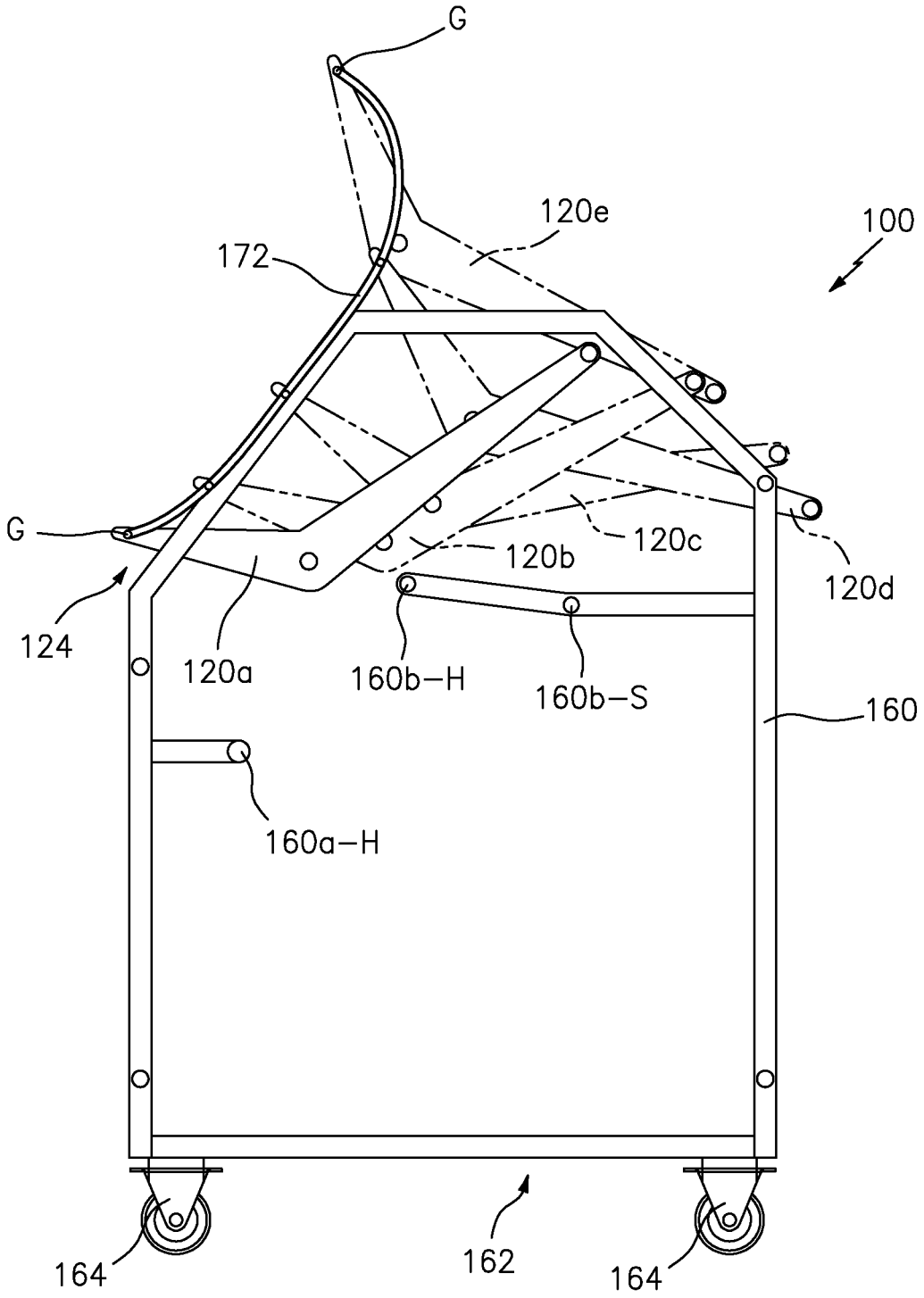
FIG. 2 is a simplified side view showing a J-shape travel path according to the first embodiment.
Figure 3:
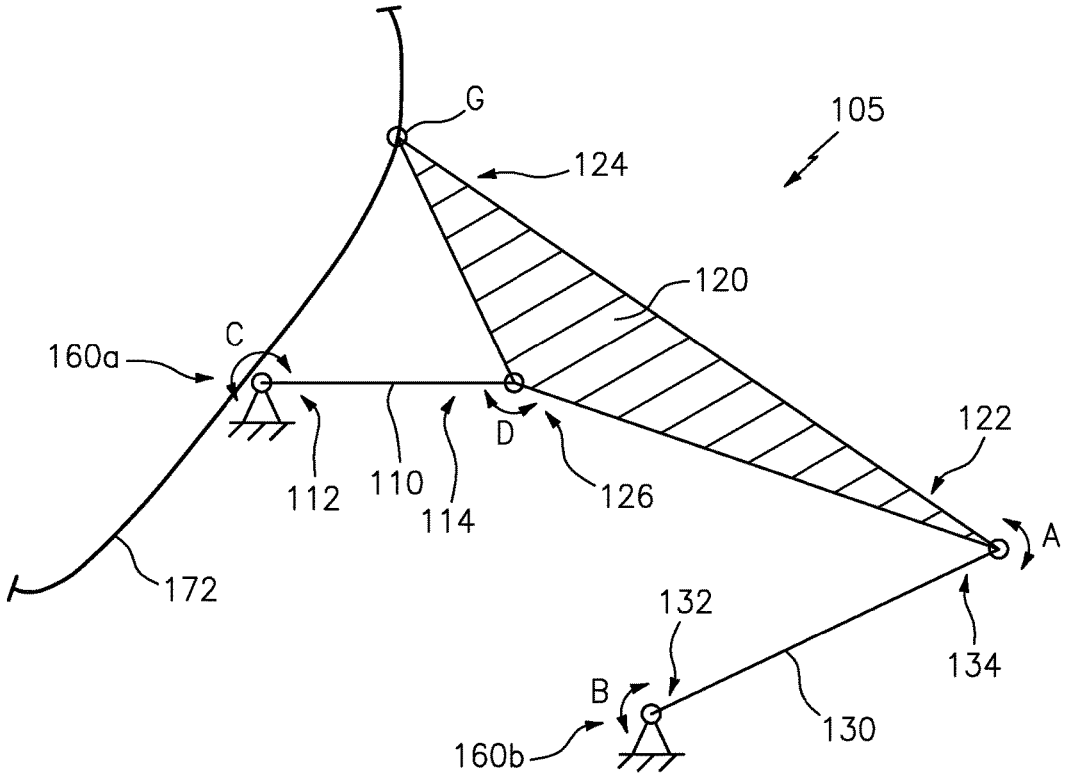
FIG. 3 is a simplified view showing the J-shape travel path and interconnection of the four bars of the lifting mechanism of the first embodiment.

In a preferred embodiment, four bars are rotatably interconnected to form a lift mechanism 105 (FIG. 3) that that replicates a natural standing motion by lifting a user 400 via a second end 124 of a coupler 120 (FIGS. 2-3). As shown in FIGS. 1-11, the lift mechanism 105 consists of four bars: a crank 110, a coupler 120, a rocker 130 and a frame 160, and an actuator, preferably an electro-mechanical actuator 180, provides a force that changes the relative positions of the bars. The lift mechanism can be positioned on either side, or on both sides, of a user 400. Alternatively, the user can straddle a single lift mechanism.

FIG. 1 shows user 400 moving between seated and standing positions, with the user being lifted from a shoulder point according to a first embodiment of the present invention. FIGS. 1-3 show a J-shape path 172 traveled by the user's shoulder when moving between seated and standing positions, with the progression of the coupler during the lifting motion shown in FIG. 2 as items 120*a* through 120*e*.

FIGS. 1 and 4-7 show lifting from the shoulders, typically accommodated by attachment to a garment worn by a patient or user 400 of the apparatus, for example a vest described in U.S. Pat. No. 6,122,778 or sold under a LiftVest® trademark. The vest is preferably modified to include one or more detachable seat belt type attachments for removably fixing the vest to lift point G (FIGS. 1-5 and 7).

Figure 4:
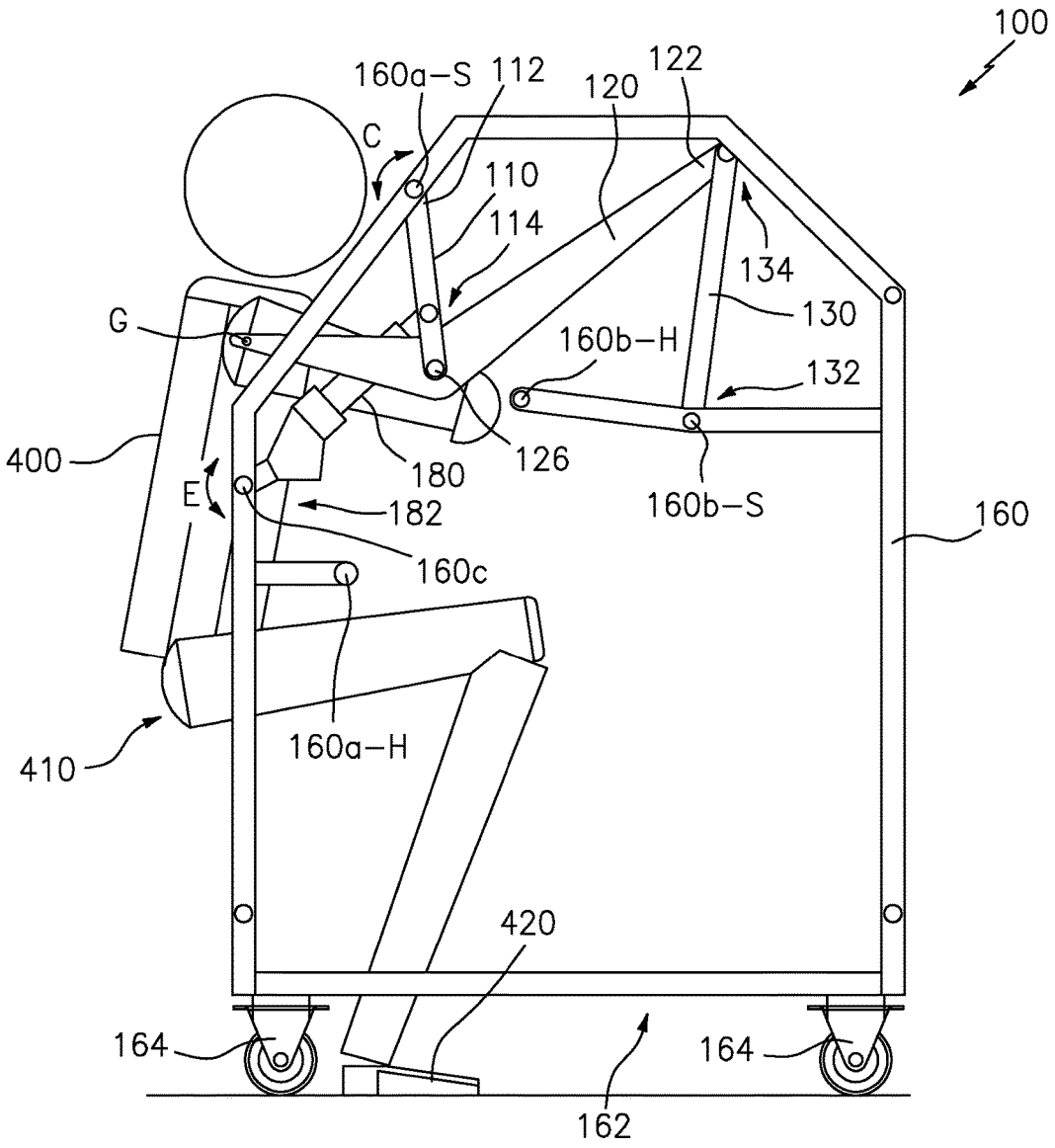
FIG. 4 is a side view of the apparatus of the first embodiment, with the four bar mechanism in a retracted mode and the user in the seated position.
Figure 5:
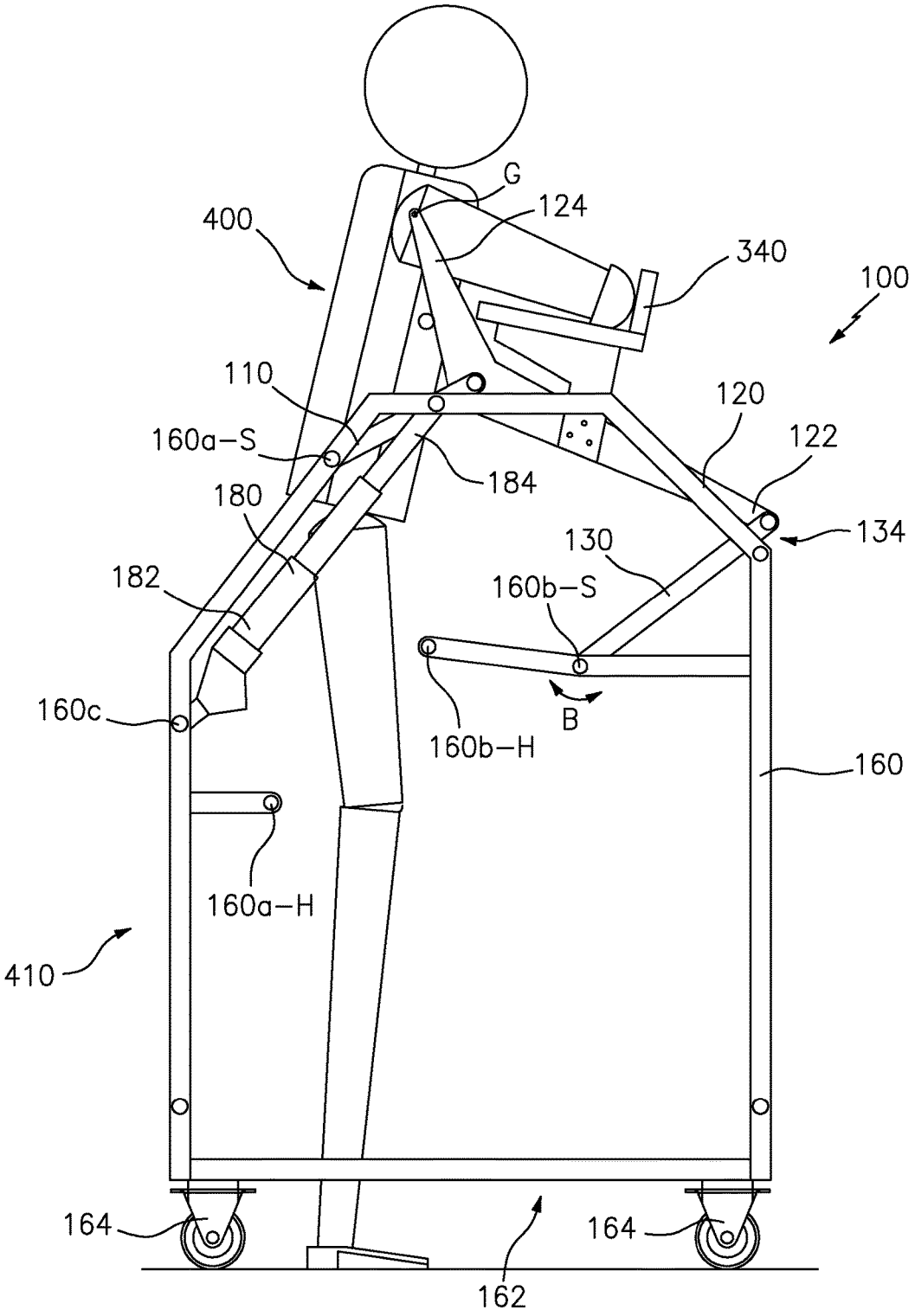
FIG. 5 is a side view of the apparatus of the first embodiment, with the four bar mechanism in an extended mode and the user in the standing position.
Figure 6:
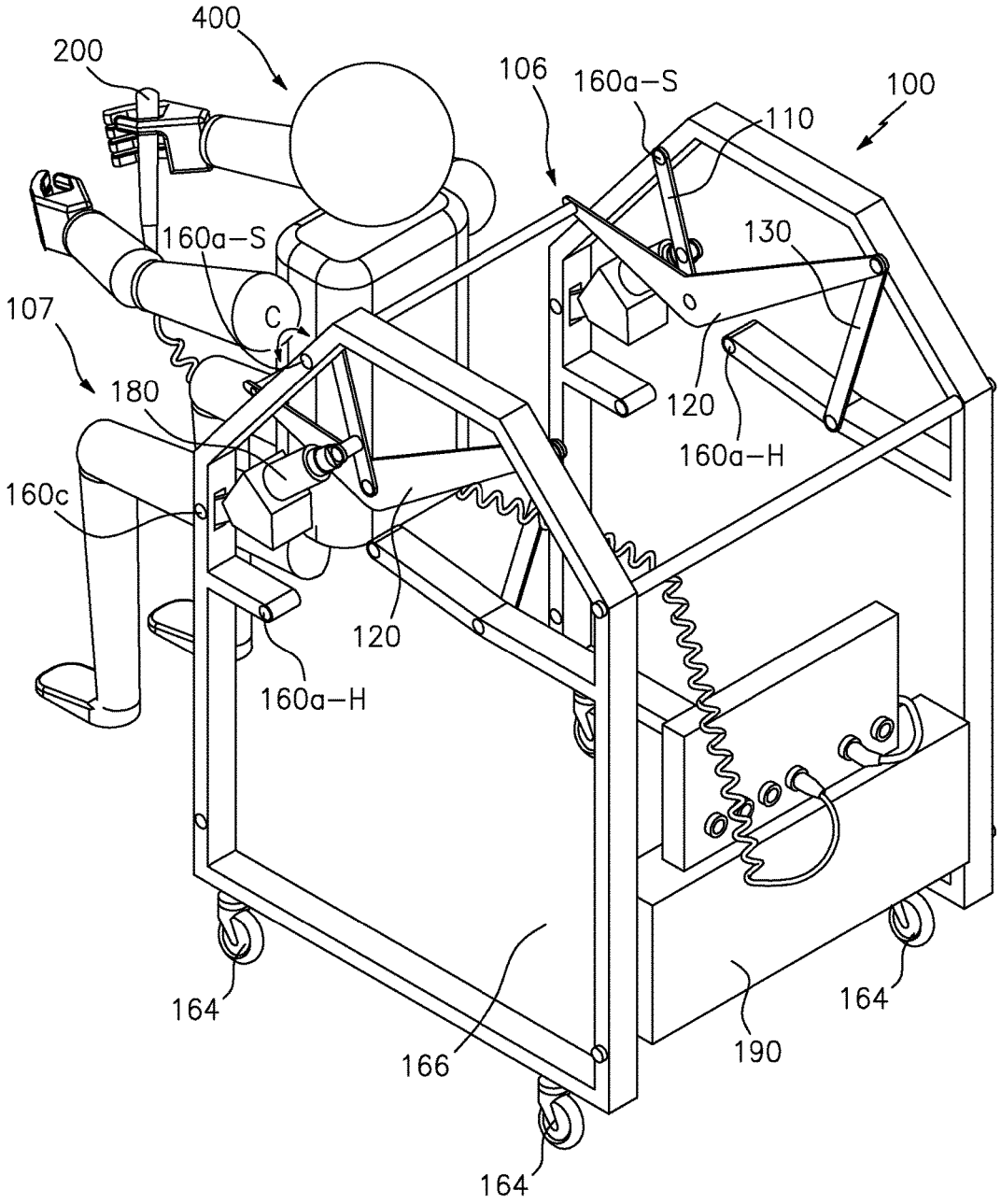
FIG. 6 is a perspective view of the apparatus of the first embodiment, with the four bar mechanism in the retracted mode and the user in a reverse orientation.
Figure 7:
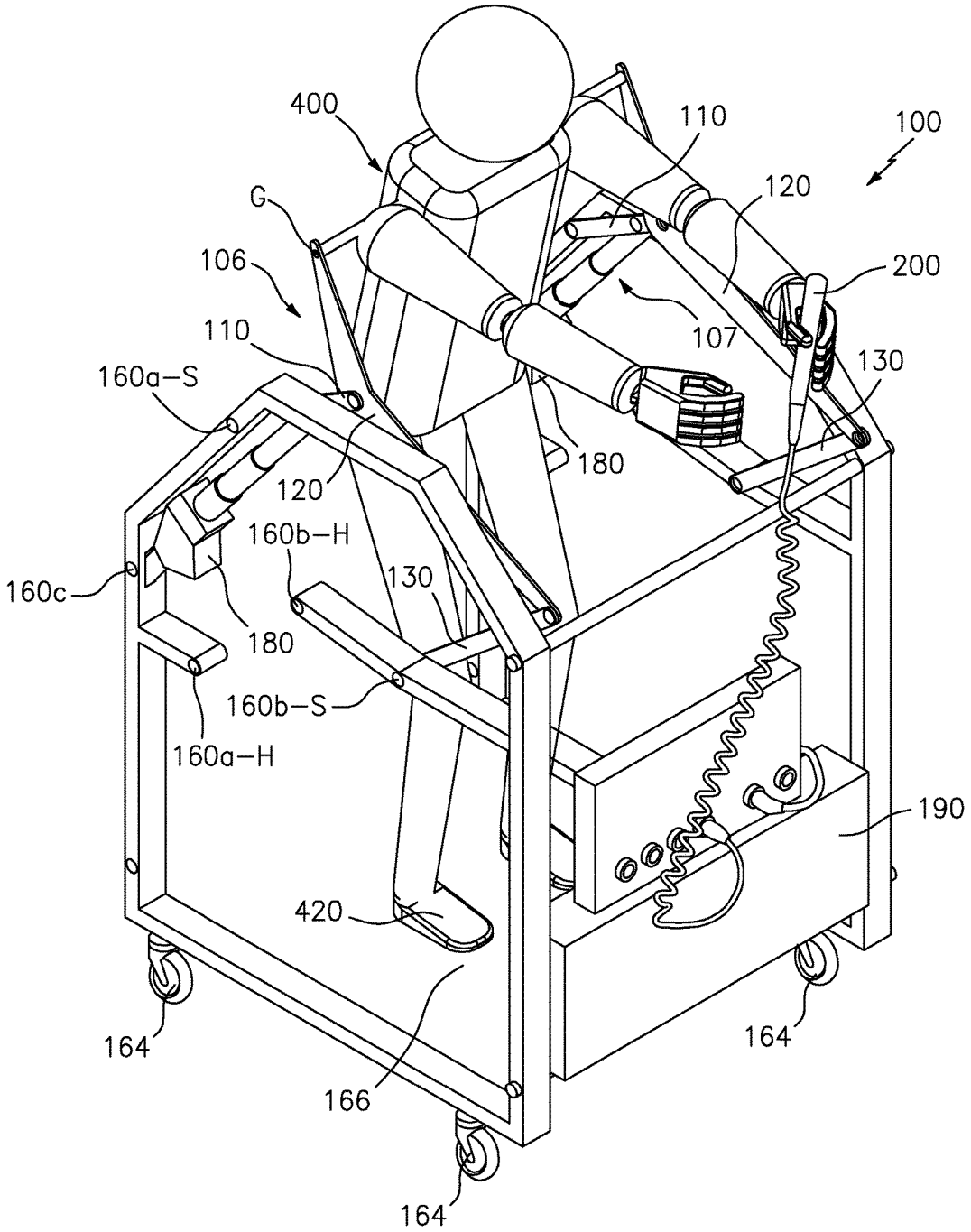
FIG. 7 is a perspective view of the apparatus of the first embodiment, showing use of the apparatus as a walker with the user in the standing position.

Lift point G is provided at a distal, i.e., second, end of 124 of coupler 120 to facilitate lifting of the user 400 by the shoulders between a retracted mode with the user in the seated position (FIGS. 4 and 6), and an extended mode with the user in the standing position (FIGS. 5 and 7, which show the apparatus of the first embodiment being used as the walker).

Figure 8:
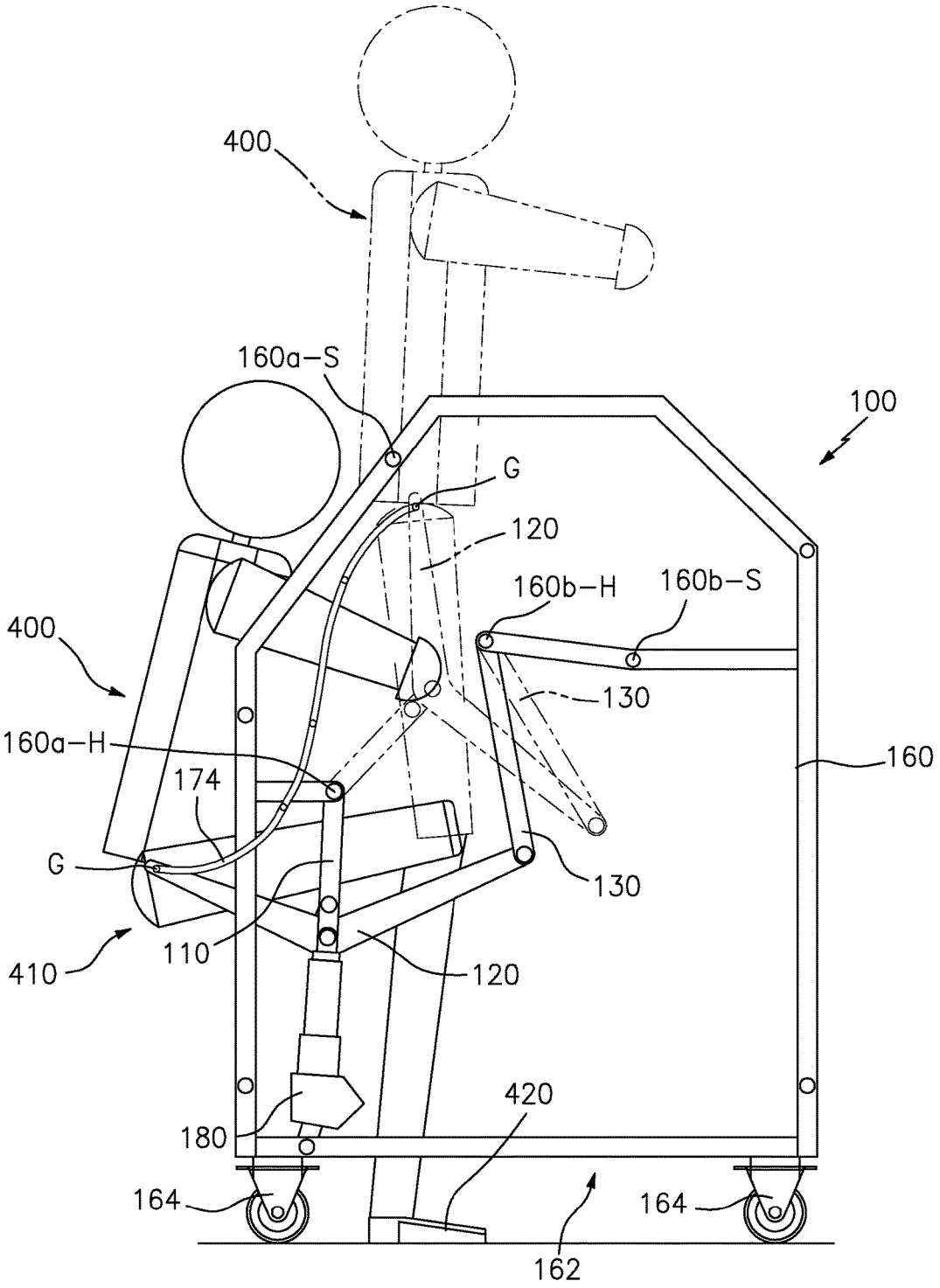
FIG. 8 is a side view showing the user in seated and standing positions according to a second embodiment of the present invention.
Figure 9:
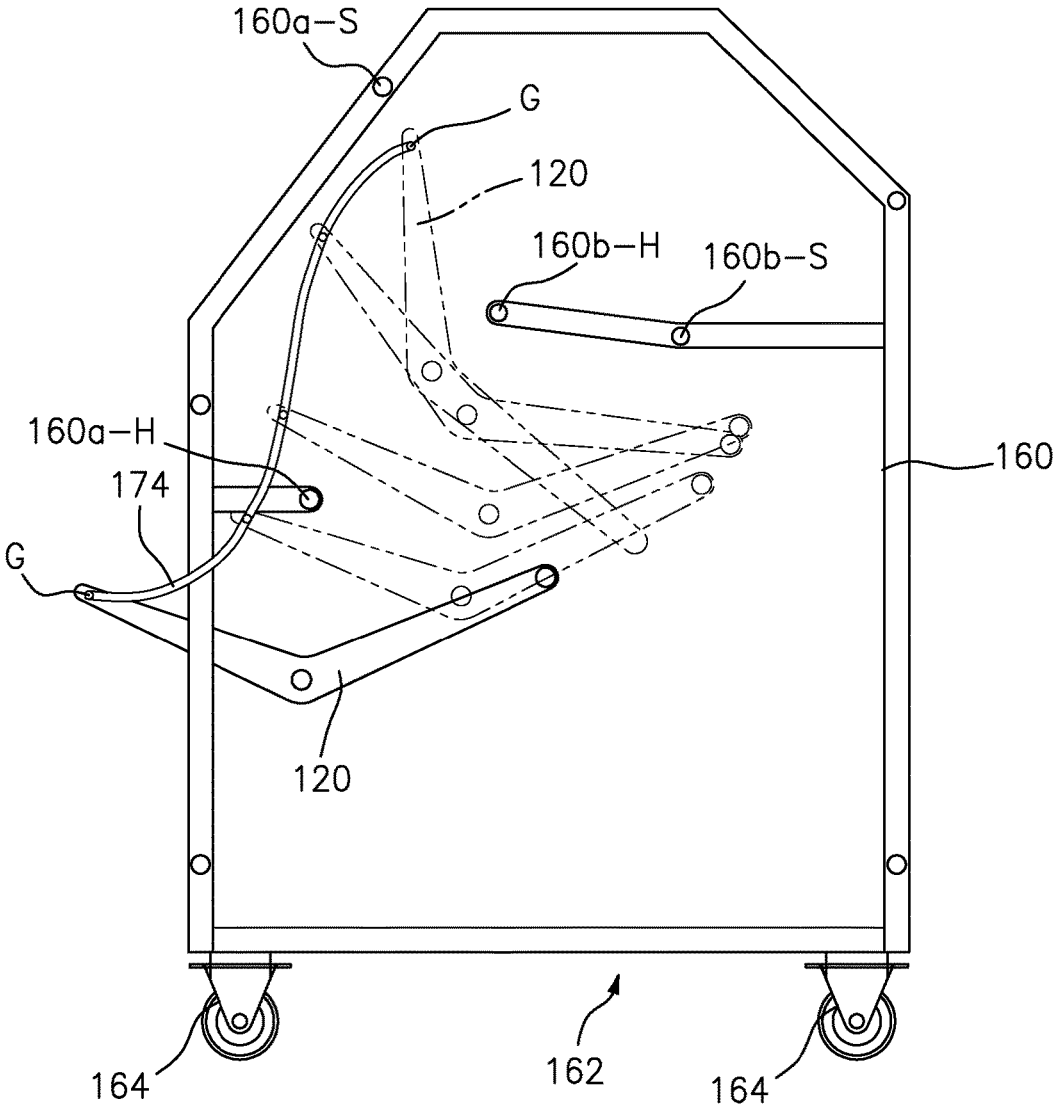
FIG. 9 is a simplified side view showing an S-shape according of the second embodiment.

FIGS. 8-13 show a second embodiment with the user 400 being lifted from a hip region utilizing the four bar lifting mechanism. FIGS. 8-9 show coupler movement and an S-shape path traveled by the user's hip when moving between seated and standing positions according to the second embodiment.

Figure 11:
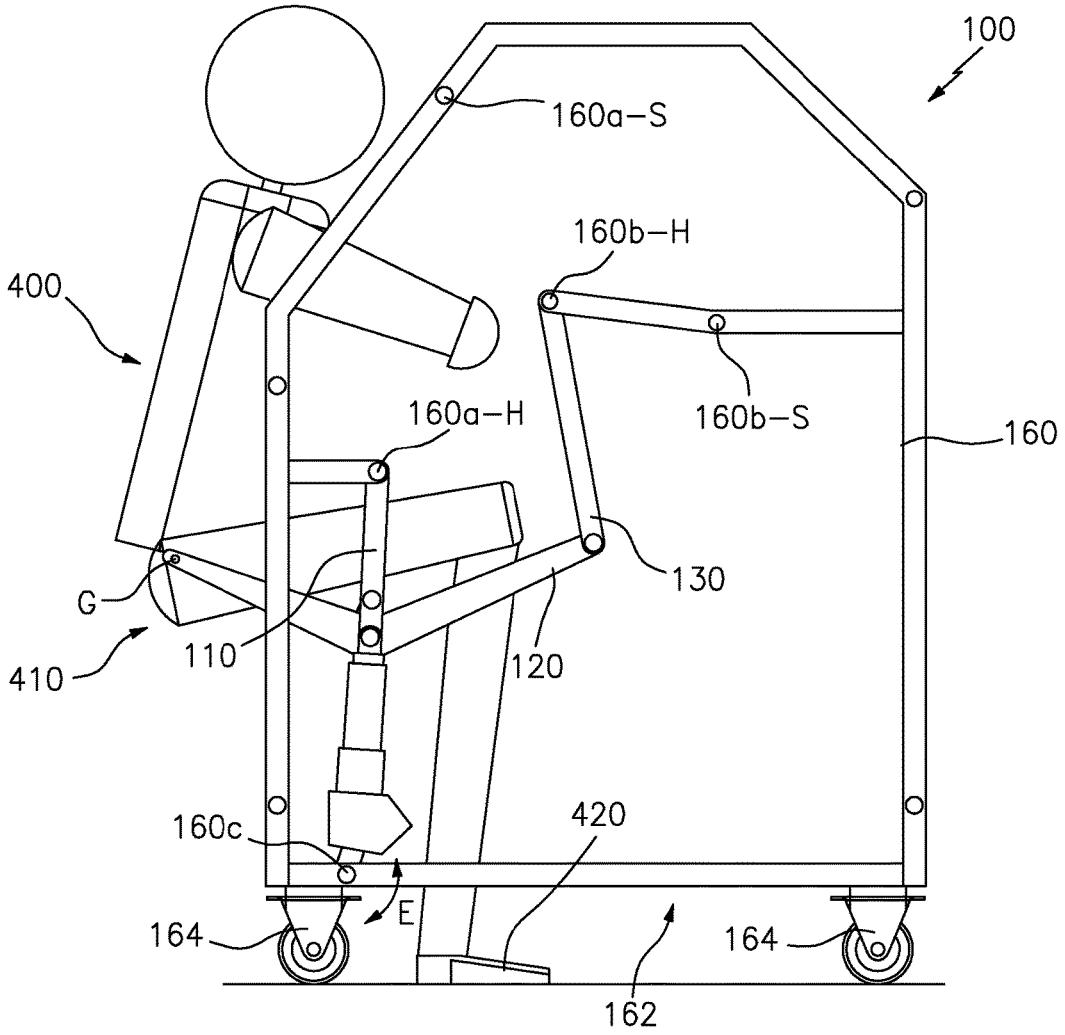
FIG. 11 is a side view of the apparatus of the second embodiment, with the four bar mechanism in a retracted mode and the user in the seated position.

A similar four bar mechanism can be used to provide both the first and second embodiments in the same frame, by repositioning first to third anchor points 160 *a-c* from the positions shown in FIG. 4 to the positions shown in FIG. 11.

Figure 12:
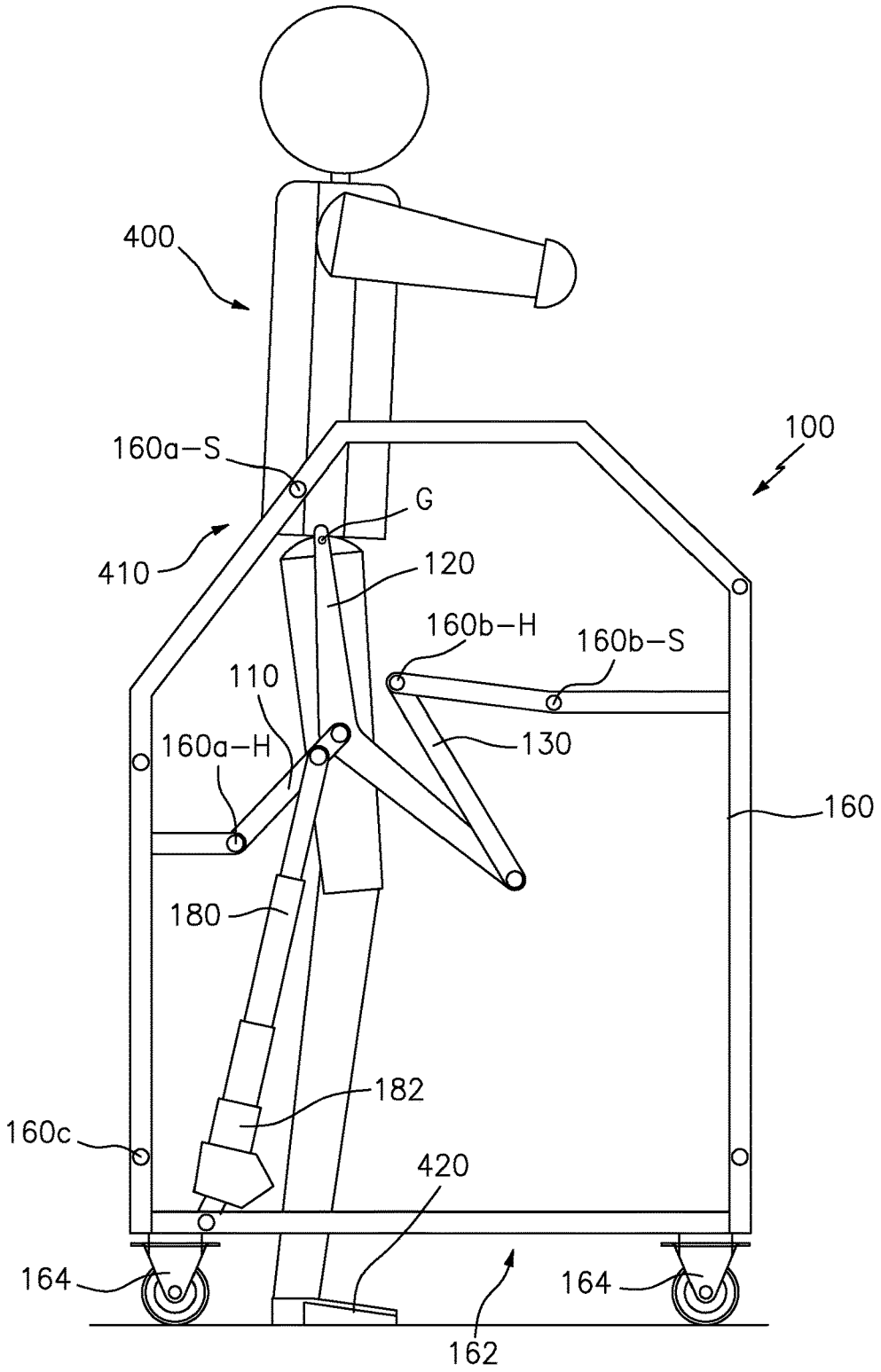
FIG. 12 is side view of the apparatus of the second embodiment, with the four bar mechanism in a extended mode and the user in the seated position.

In the second embodiment, lift point G is also provided at the second end of 124 of coupler 120 to facilitate lifting of user 400 between the retracted mode with user 400 in the seated position (FIGS. 11 and 13), and an extended mode with the user in the standing position (FIG. 12, which shows the apparatus of the second embodiment being used as the walker).

The shoulder joint path mechanism of the first embodiment allows user 400 to be held from the upper torso, which allows easier harness attachment, as opposed to hip joint attachment, which can require initial lifting of user 400 to position a hip harness beneath the buttocks. Also, since user 400 is supported from the upper torso in the first embodiment, hand bars 340 or crutch supports are readily adaptable for use in the first embodiment (FIG. 5), with hand bars 340 following the same path of the motion, to provide synchronized motion that varies horizontal orientation of an arm rest coupled to hand bar, with horizontal variation changing based on vertical movement, thereby providing a synchronized ergo dynamic variable platform for the user to rest his or her forearms. The hip joint mechanism of the second embodiment has advantages that include mounting the mechanisms for the lifting apparatus at a lower height on the frame, thereby reducing metacentric height to increase stability and enhance user comfort.

FIGS. 1-2 and 8-9 show progression of and change of orientation of coupler 120 when moving between seated and standing positions, for the first and second embodiments, respectively. For clarity, FIGS. 1-2 and 8-9 highlight two of the four bars, i.e., the coupler 120 and frame 160.

Figure 10:
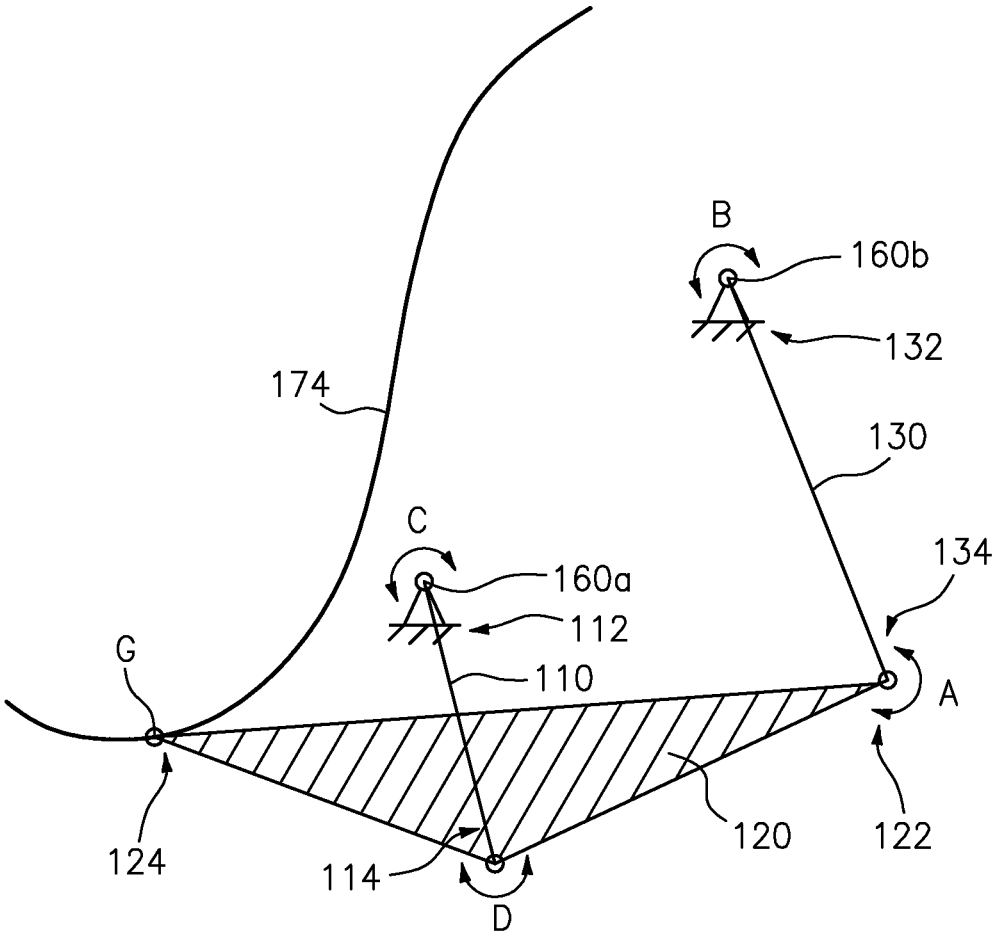
FIG. 10 is a simplified view showing the S-shape travel path and interconnection of the four bars of the lifting mechanism of the second embodiment.

In each of the first and second embodiments, a first end 182 of actuator 180 rotatably connects to a point on the crank 110 between the first and second ends 112, 114. Each of the coupler 120, rocker 130 and actuator 180 have first and second ends at each of which a rotatable connection is provided about axes A-D, respectively, as shown in FIGS. 3 and 10, with each axis being perpendicular to a transverse length of the coupler 120, rocker 130 and actuator 180. The coupler 120 includes rotatable connections to the other bars of the four bar mechanism, other than frame 160, at a first end 122 and a midpoint 126 thereof, with a second end 124 of the coupler 120 utilized for lifting of user 400 via attachment to point G.

Crank 110 rotatably connects at the first end 112 thereof to a first anchor point of frame 160, rotating about axis C. In the first embodiment, the connection of the first anchor point is provided at first anchor 160*a*-S, as shown in FIGS. 3-5. In the second embodiment, the connection of the first anchor point is provided at first anchor 160*a*-H, as shown in FIG. 10, and described further below.

The second end 114 of crank 110 rotatably connects at axis D to midpoint 126 of coupler 120. It will be recognized by those of skill in the art that the midpoints are not necessarily positioned at a precise middle of each respective bar. Rather, the midpoint is positioned between the first and second ends of the respective bar.

Lift point G is provided at second end 124 of coupler 120 in both the first and second embodiments. First end 122 of coupler 120 rotatably connects to second end 134 of rocker 130, rotatable about axis A. A second end 132 of rocker 130 rotatably attaches to frame 160 at a second anchor 160*b*, rotatable about axis B.

In a preferred embodiment, as shown in FIGS. 4 and 12, actuator 180 is provided having a first end 182 connected to a third anchor 160*c*, also referred to as the actuator anchor, rotatable about axis E, shown in FIGS. 4 and 11, with each of the anchors provided at fixed positions on frame 160, and the first and second embodiments herein being provided by repositioning the anchors on frame 160. The second end 184 of actuator 180 connects to the crank 110, between first and second ends 112, 114 thereof.

Actuator 180 can be provided as a linear actuator, such as an electro-mechanical actuator or a pneumatic or hydraulic piston rotatably coupled at opposite ends to the frame 160 at actuator anchor 160*c* and to the crank 110 or other bar of the four bar mechanism. Extension or retraction of the actuator supplies longitudinal force to move the interconnected bars around respective axes, to lift/lower lift point G. Alternatively, the relative position of each of the four bars is varied by application of torque at one or more fixed pivot, such as by stepper motor.

In a preferred embodiment, a controller is provided for use by user 400 or a caregiver, with up/down buttons and controls provided thereon to operate the actuators/rotational motor, thereby lifting/lowering the user 400 to the standing/seated position, as well as to control a remote wheel locking mechanism for the wheels akin to a walker handbrake, thereby providing greater stability during lifting. Limit switches are also preferably provided to indicate fully retracted/extended positions and stop actuation when reaching same. In addition, for a controller that is not fixed to the frame, a dead-man switch is included to stop operation if user 400 drops the controller, thereby stopping the lifting operation and avoiding potentially dangerous situation.

When the above described interconnections are made of the crank 110, coupler 120, and rocker 130, to first and second anchors of frame 160, operation of actuator 180 results in the lift point G traveling the J shape path in the first embodiment and the S shape path of the second embodiment, thereby facilitating lift via point G from a user shoulder area and hip area, respectively.

In particular, a plurality of first anchors (160*a*-H, 160*a*-S) are provided on frame 160 for alternative rotatable connection to first end 112 of crank 110, and a plurality of second anchors (160*b*-H, 160*b*-S) are provided on frame 160 for alternative rotatable connection to first end 132 of rocker 130. When a lower anchor 160*a*-H of the plurality of first anchors is rotatably connected to the first end 112 of the crank 110 and a lower anchor 160*b*_H of the plurality of second anchors is rotatably connected to the first end 132 of the rocker 130, the lift point follows a J-shape path to lift a user from the shoulder region. When an upper anchor 160*a*-S of the plurality of first anchors (160*a*-H, 160*a*-S) is rotatably connected to the first end 112 of the crank 110 and an upper anchor 160*b*-S of the plurality of second anchors (160*b*-H, 160*b*-S) is rotatably connected to the first end of the rocker, the lift point follows an S-shape path to lift a user from the hip region.

An actuator 180 applies force to rotate the crank 110 about a third axis C relative to frame 160, and the force of the actuator assists patient standing and sitting. The actuator force is variable during patient standing and sitting to provide incremental exercise the patient, with the controller 200 being configured to reduce the actuator force by a predetermined percentage of patient weight to facilitate an exercise routine, with a memory of the controller storing percentage effort exerted by the patient during the exercise routine. Controller 200 monitors and varies the actuator force, with the controller 200 determining patient weight by load sensor input, optionally based on caregiver input.

Figure 13:
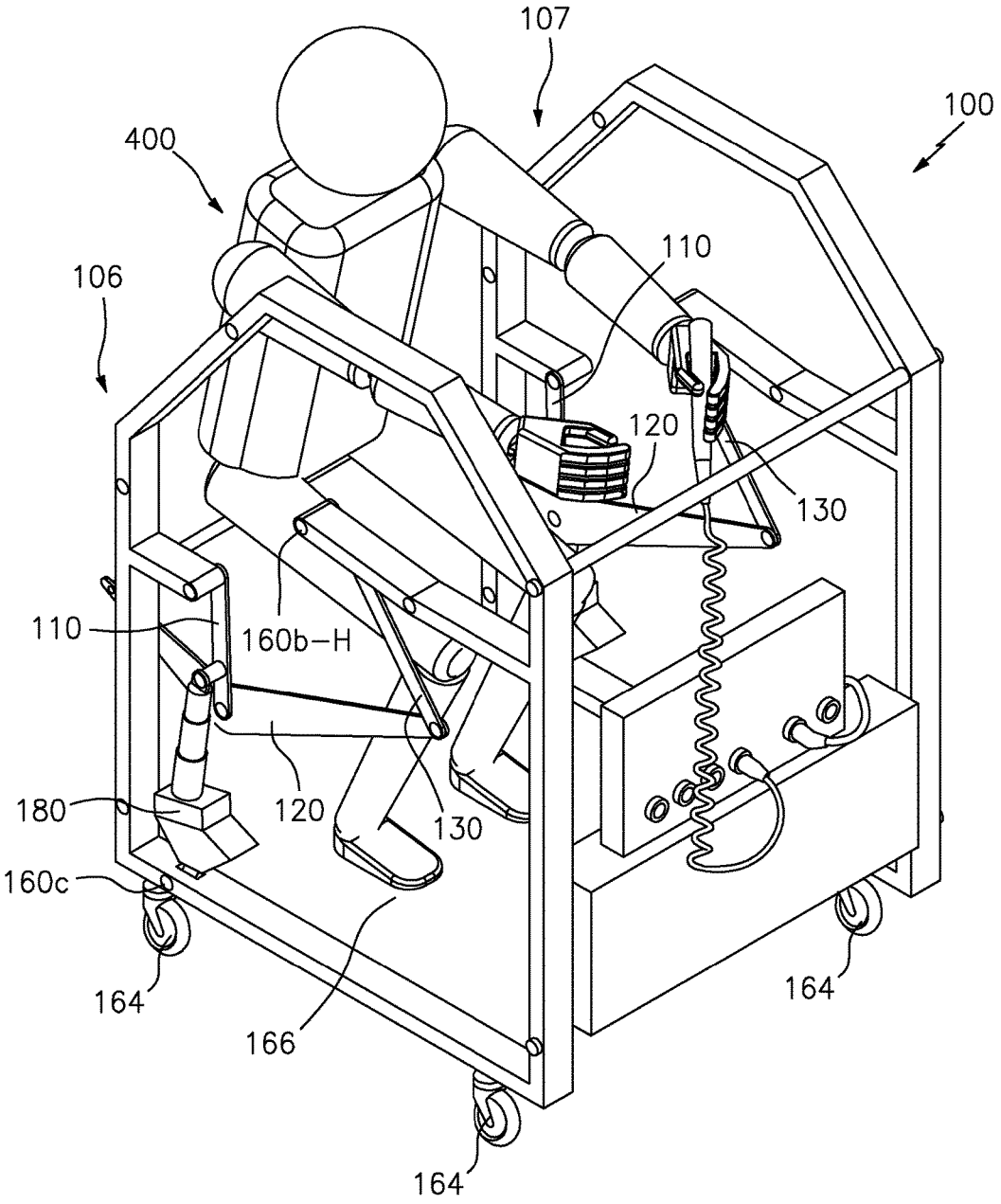
FIG. 13 is profile view of the apparatus of the second embodiment, with the four bar mechanism in a retracted mode and the user in the seated position.

In a preferred embodiment, parallel first and second four bar lifting mechanisms 106 and 107 are provided on opposite sides of frame 160, creating a free space S there between, as shown in FIGS. 6-7 and 13. Supporting user 400 within free space S allows user 400 to swing his/her foot 420 in an unimpeded fashion through free space S, to propel the apparatus 100 user 400 without bearing any or only a portion of the user's weight on either foot 420, via wheels, e.g., casters 164, positioned on an underside of frame 160. Casters 164 can, in a preferred embodiment, be unidirectional and/or controllable to control acceleration and braking, to allow user 400 to advance in a desired direction by operation controlled by controller 200.

In a preferred embodiment, the opposite sides of the frame 168, 169 have separate actuators 180 for each of the first and second four bar lifting mechanism 106, 107, and a closed loop control is provided to adjust for unbalanced loading conditions by providing greater amperage to a controller upon detection of uneven actuator loading. In another embodiment, a single lifting mechanism is provided at a center of the walker frame, and the user swings his/her feet on the sides of the mechanism.

The invention is not limited to the disclosed preferred embodiments, and should be construed to cover all such alternatives, modifications and equivalents as defined in the appended claims.

What is claimed is:

1. An apparatus comprising:

a crank;

a rocker;

a frame;

a coupler having a lift point on a first end thereof;

a plurality of first anchors on the frame, each configured to rotatably connect to a first end of the crank; and a plurality of second anchors on the frame, each configured to rotatably connect to a first end of the rocker, wherein a first end of the coupler opposite the lift point rotatably connects to a second end of the rocker at a first axis, wherein the first end of the rocker rotatably connects to the frame at a second axis, wherein the first end of the crank rotatably connects to the frame at a third axis, wherein a second end of the crank rotatably connects to the coupler at a fourth axis, and wherein one of raising and lowering of the lift point is performed by rotation of the coupler relative to the rocker, the rocker relative to the frame, the crank relative to the frame, and the crank relative to the coupler.

2. The apparatus of claim 1, further comprising an actuator configured to apply a force to rotate the crank about the third axis relative to the frame.

3. The apparatus of claim 2, further comprising a controller to monitor and vary the actuator force.

4. The apparatus of claim 3, wherein the controller determines patient weight by input from load sensors.

5. The apparatus of claim 4, wherein the controller is configured to reduce the actuator force by a predetermined percentage of patient weight to facilitate an exercise routine.

6. The apparatus of claim 5, wherein the controller is configured to reduce the actuator force based on input from a caregiver.

7. The apparatus of claim 5, wherein the controller includes a memory for storing percentage effort exerted by the patient of the exercise routine.

8. The apparatus of claim 2, wherein the force of the actuator assists one of patient standing and patient sitting.

9. The apparatus of claim 8, wherein the actuator force is varied during one of the patient standing and the patient sitting, to exercise the patient.

10. The apparatus of claim 1, wherein, when a lower anchor of the plurality of first anchors is rotatably connected to the first end of the crank and a lower anchor of the plurality of second anchors is rotatably connected to the first end of the rocker, the lift point follows a J shape path during raising and lowering.

11. The apparatus of claim 1, wherein, when an upper anchor of the plurality of first anchors is rotatably connected to the first end of the crank and an upper anchor of the plurality of second anchors is rotatably connected to the first end of the rocker, the lift point follows an S-shape path during raising and lowering.

12. The apparatus of claim 1, further comprising wheels affixed to an underside of the frame.

13. An apparatus comprising:

an actuator;

a crank;

a rocker;

a frame;

a coupler having a lift point on an end thereof;

a plurality of first anchors on the frame, each configured to rotatably connect to a first end of the crank; and a plurality of second anchors on the frame, each configured to rotatably connect to a first end of the rocker, wherein a first end of the coupler opposite the lift point rotatably connects to a second end of the rocker at a first axis, wherein the first end of the rocker rotatably connects to the frame at a second axis, wherein the first end of the crank rotatably connects to the frame at a third axis, wherein a second end of the crank rotatably connects to the coupler at a fourth axis, wherein one of raising and lowering of the lift point is performed by rotation of the coupler relative to the rocker, the rocker relative to the frame, the crank relative to the frame, and the crank relative to the coupler, and wherein the actuator is configured to apply a force to rotate the crank about the third axis relative to the frame and the force is varied during at least one of patient standing and patient sitting.

14. A method for providing patient exercise, the method comprising:

positioning the patient in an apparatus comprising:

an actuator, a crank, a rocker, a frame, a plurality of first anchors affixed to the frame and configured to rotatably connect to a first end of the crank, a plurality of second anchors affixed to the frame, each configured to rotatably connect to a first end of the rocker, and a coupler having a lift point on a first end thereof;

applying, by the actuator, a force to rotate the crank about a third axis relative to the frame for at least one of patient standing and patient sitting; and varying the force during at least one of the patient standing and the patient sitting, wherein a second end of the coupler opposite the lift point rotatably connects to a second end of the rocker at a first axis, wherein the first end of the rocker rotatably connects to the frame at a second axis, wherein the first end of the crank rotatably connects to the frame at the third axis, wherein a second end of the crank rotatably connects to the coupler at a fourth axis, and wherein one of raising and lowering of the lift point is performed by rotation of the coupler relative to the rocker, the rocker relative to the frame, the crank relative to the frame, and the crank relative to the coupler.

* * * * *